US005094508A

United States Patent [19]

Bathrick et al.

[11] Patent Number: 5,094,508

[45] Date of Patent: Mar. 10, 1992

[54] ELEVATOR CHAIR

[75] Inventors: Leeland M. Bathrick, Crystal Lake; Glenn Brittain, McHenry, both of Ill.

[73] Assignee: C.E.B. Enterprises, Inc., Mundelein, Ill.

[21] Appl. No.: 598,842

[22] Filed: Oct. 15, 1990

[51] Int. Cl.[5] ..... A47C 1/02

[52] U.S. Cl. ..... 297/320; 297/330; 297/DIG. 10

[58] Field of Search ..... 297/330, 340, 345, DIG. 10, 297/320

[56] References Cited

U.S. PATENT DOCUMENTS

| | | | |
|---|---|---|---|
| 3,851,917 | 12/1974 | Horstmann et al. | 297/DIG. 10 |
| 3,925,833 | 12/1975 | Hunter | 297/DIG. 10 |
| 4,031,576 | 6/1977 | Epstein | 297/DIG. 10 |
| 4,249,774 | 2/1981 | Andreasson | 297/DIG. 10 |
| 4,545,616 | 10/1985 | Booth | 297/DIG. 10 |
| 4,616,874 | 10/1986 | Dietsch et al. | 297/330 X |

*Primary Examiner*—Peter A. Aschenbrenner

[57] ABSTRACT

An elevator chair for assisting entry and exit including a vertically telescopic back frame raised and lowered by a motor driven vertical threaded screw and tube assembly. The back frame raises and lowers a rear portion of a seat and movement of the front of the seat is controlled by forward links that are positioned to raise the forward portion of the seat as the chair lifts.

7 Claims, 3 Drawing Sheets

ELEVATOR CHAIR

BACKGROUND OF THE INVENTION

Elevator chair mechanisms that assist user entry and exit from a seat portion of the chair, while initially successful in the nursing home and clinic marketplaces have only recently achieved some degree of success in the residential marketplace. Formerly believed desirable only for patients with severe lower extremity immobility, today such chair elevator or lift systems have found acceptance by users with significantly lesser handicaps including those with simply inflammatory arthritis in the lower extremity joints and other orthopedic maladies commonly found in people over 50 years of age.

In the residential market of course the chair mechanism must be aesthetically acceptable and complementary to the home environment which necessitates the motor drive assembly be compact and located where it may be easily covered by upholstery. It also requires the lift linkages or arms be similarly located to be easily concealed by fabric. More importantly, the linkage or actuator assembly for the chair should have a low power requirement in order to reduce the size of the drive motor necessary, and decreased power consumption to provide a lift chair at a lower cost than formerly available.

There have been a plurality of attempts at designing such chair mechanisms and one is shown in the Gaffney, U.S. Pat. No. 3,250,569 which shows a conventional home-style lounge chair where the seat moves upwardly and tilts forwardly to facilitate user exit. The design is compact and has a few number of links and for that reason it is for the most part acceptable in the residential market. However in this chair only the seat elevates and the back remains in a stationary position with the arms, so the user has some apprehension in entering and exiting the chair because in the entry and exit position the user cannot contact the back at all and the arms are in a very depressed position relative to the seat.

There are however seat mechanisms designed in the past where the arms and back move upwardly and forwardly and one is illustrated in the Gaffney, U.S. Pat. No. 4,083,599. In this design the seat, back and arms are one unitary assembly all stationary with respect to one another and the chair is raised and lowered by a pair generally parallel arms generally horizontally disposed fixed at the rear to a stationary frame plate and at the front to a lift frame for the chair. The actuator is a screw drive and also acts as a third extending link connected at the rear to the same frame and at its front end to the forward center portion of the chair frame. This parallelogram type linkage has high power requirements and thus necessitates an excessively large motor for the residential marketplace. Also the location of the various links underneath the chair frame require a substantial amount of additional upholstery to cover the linkage mechanism and provide a safe actuation system.

The Gorden, U.S. Pat. No. 2,608,239 shows a threaded screw actuator that raises and lowers a chair back bar with side members slidable in generally vertical grooves in vertical rails. The Gorden chair lifts as a unit and has no seat tilting.

The Yates, et al., U.S. Pat. No. 3,343,871 shows an automatically operated invalid chair that has a reclining back and a seat frame that moves with a slotted follower mechanism to lift and seat tilt positions. There is no upward movement of the front portion of the seat upon lift.

The Gaffney, U.S. Pat. No. 4,007,960 discloses a mechanism for back to seat articulation, ottoman extension and chair lift. As in the above Gaffney patent, the actuator assembly and linkage is disposed entirely underneath the seat demanding very high power requirements and this chair has problems with exposed linkages and upholstery around the linkage mechanism under the seat. Furthermore, as in the above Gaffney elevator chair, the seat back tilts forwardly upon lift which is not really desirable.

The Randolph, U.S. Pat. No. 4,077,483 shows a track-type invalid vehicle where the seat is movable to a raised position with a generally vertical threaded screw. The screw lifts the entire chair, and there is no seat to back articulation or seat tilting.

The Andreasson, U.S. Pat. No. 4,249,774 shows a chair lift mechanism, but in this device while the seat articulates, it does so in two pieces and there is no articulation between the seat portion and the back portion.

The Booth, U.S. Pat. No. 4,545,616 shows a lift mechanism for a mobile chair with elevating seat where the seat is raised by a vertical screw that lifts the seat back. It does show articulation between the chair back and the seat frame with a generally parallelogram type linkage. Because of this four bar linkage, the back of the chair moves relatively toward the front of the seat as the chair is lifted. This is permitted by wheels that support a front link of the chair in one embodiment and the seat back in another embodiment, both designed for horizontal translating movement.

The Krauska, U.S. Pat. No. 4,852,939 shows a device for converting or retrofitting a recliner chair to a recliner lift chair with a mechanism somewhat similar to the mechanism shown in the Gaffney, U.S. Pat. No. 4,007,960 described above, except that it does appear that Krauska's arms articulate relative to the seat. Krauska does not include any chair back to seat articulation and note that the seat frame is pivotally mounted by spaced short links on a control rail that scissors with the seat frame to effect ottoman scissor linkage movement.

It is a primary object of the present invention to ameliorate those problems noted above in chair assemblies that provide for seat lifting to facilitate entry and exit from the chair.

SUMMARY OF THE PRESENT INVENTION

In accordance with the present invention, an improved elevator chair is provided for assisting entry and exit where the chair back is raised and lowered without tilting and lifts the chair seat portion at its rear in linear fashion tilting the seat forwardly with control links at the forward end of the seat portion that permit the forward part of the seat to lift upwardly to a lesser extent than the rear.

The seat back is reciprocated upwardly and downwardly by a linear threaded actuator that engages a seat back frame telescopic mechanism. By driving the seat back directly in pure vertical reciprocating motion, the power requirements for the motor drive are significantly reduced and the linkage normally required underneath the seat in prior designs is virtually non-existent. This is because the actuator is positioned substantially in a single plane coincident with the seat back, although extending to the floor. The only linkage required is a single link at each of the forward sides of the seat frame that articulate it to the chair frame, and these links are generally horizontal in the down position so that they occupy virtually no vertical space beneath the seat.

As the actuator drives the chair back linearly upwardly, the seat is effectively pulled upwardly by the chair back at the rear of the seat, and the seat pivots relative to the back tilting forwardly to facilitate exit. The chair arms are also carried by the seat frame so they move upwardly and can be conveniently used in entering and exiting the chair.

One of the principal advantages of the present chair mechanism is that it achieves chair lift with chair back articulation with respect to seat so that the back does not push the user out of the seat during lift. Another important aspect is that the forward end of the seat lifts to be certain the user's legs behind the knees are fully supported during entry and exit to give the user a more secure transition.

Another important advantage of the present invention is that seat to back articulation during lift and forward seat rise are all achieved with an absolute minimum linkage providing not only a lower cost design but one which safer, has lower power requirements and requires significantly less upholstery to conceal the operating mechanism.

Other objects and advantages of the present invention will appear more clearly from the following detailed description.

DETAILED DESCRIPTION OF THE PREFERRED EMBODIMENT

Figure 1:
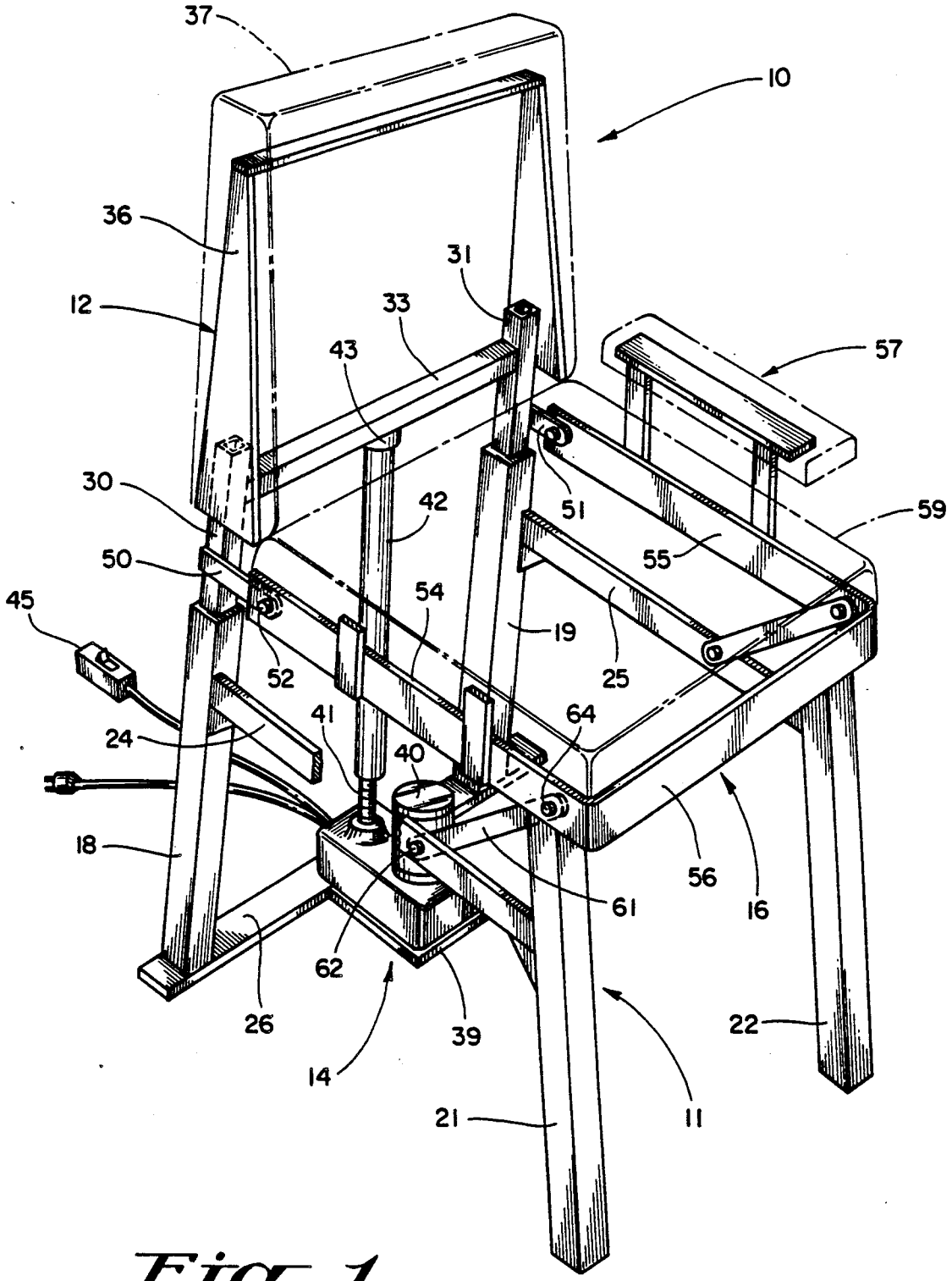
FIG. 1 is a perspective view of an improved elevator chair according to the present invention.
Figure 2:
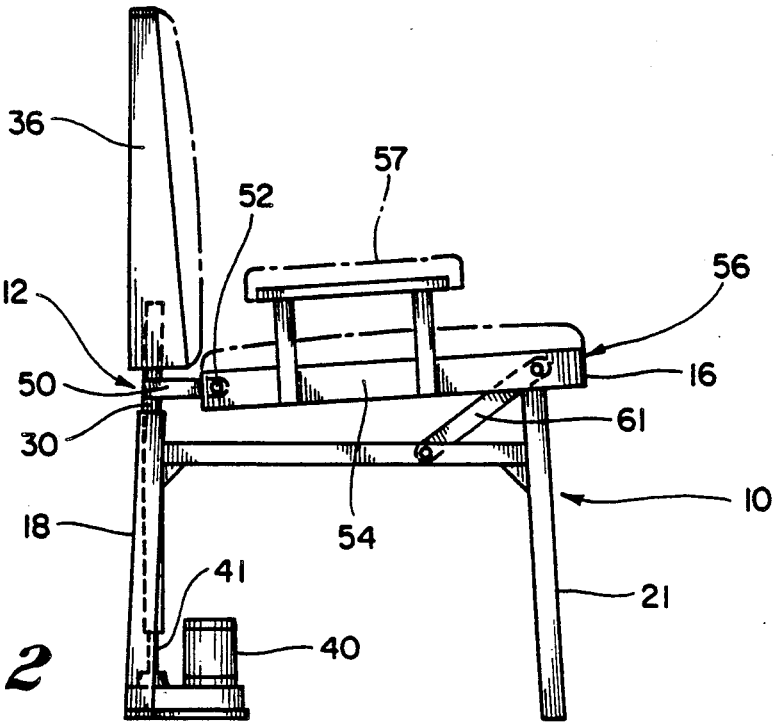
FIG. 2 is a side view of the chair illustrated in FIG. 1.
Figure 3:
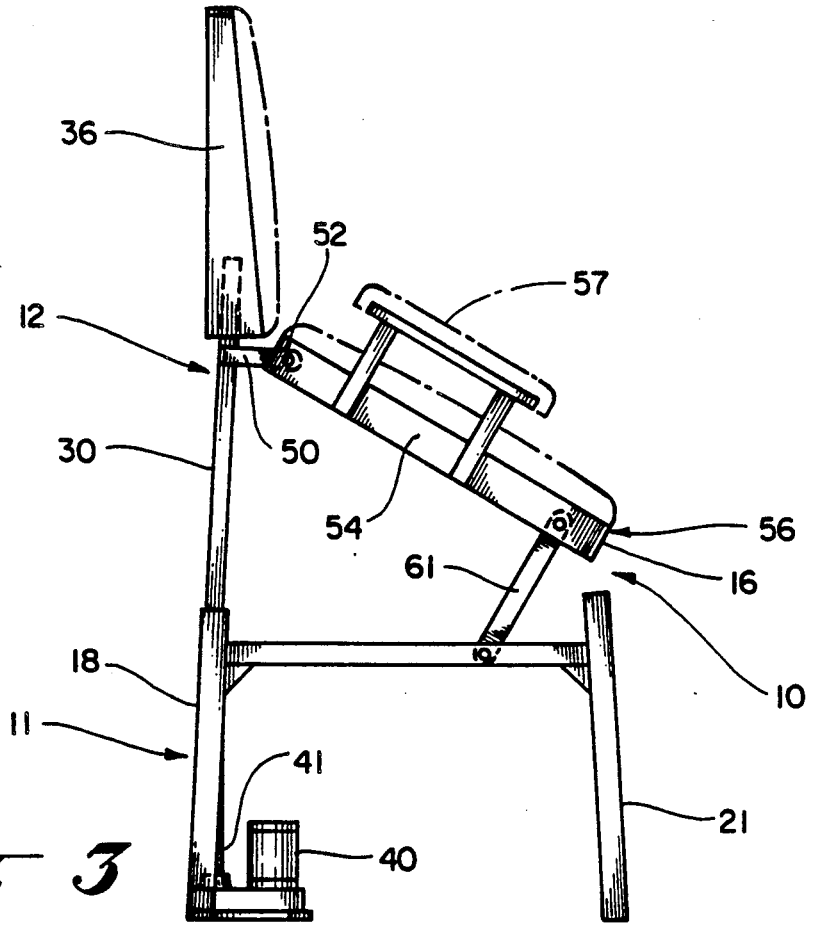
FIG. 3 is a side view of the chair illustrated in FIG. 1 similar to FIG. 2 with the chair in its lift position.
Figure 4:
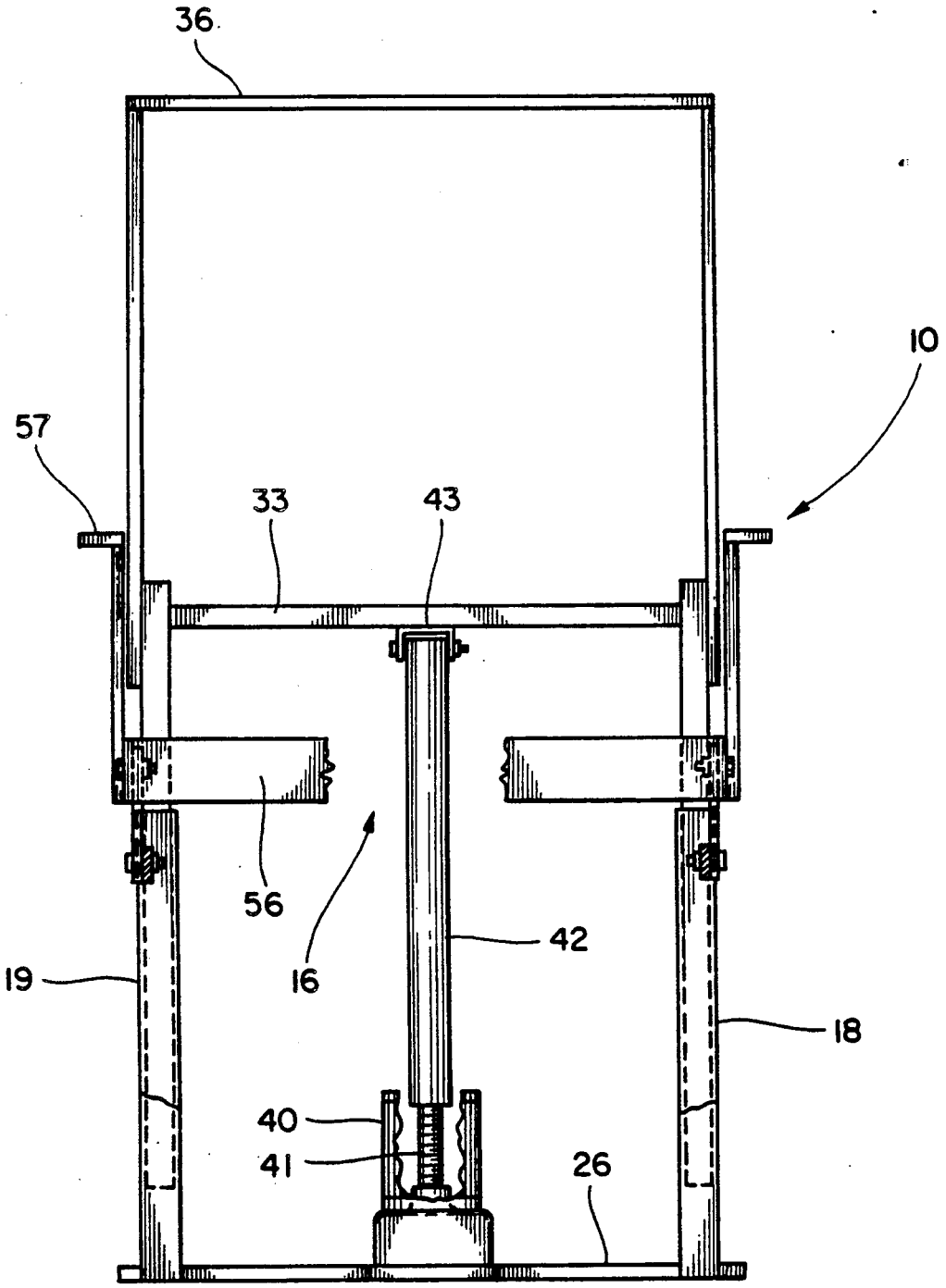
FIG. 4 is a partly fragmentary front view of the chair illustrated in FIGS. 1 to 3 in its down position.

Referring to the drawings and particularly FIGS. 1 to 4, an elevator chair assembly 10 is illustrated consisting generally of a chair frame 11, to which a back frame 12 is telescopically fitted, raised and lowered by a screw and tube actuator assembly 14, and a seat frame 16 raised and lowered from the position illustrated in FIG. 2 to the position illustrated in FIG. 4 by the back frame 12.

The chair frame 11 includes tubular legs defined by rear square tubes 18 and 19 and forward legs 21 and 22 fixed together by side members 24 and 25 and a rear bottom cross member 26. Rear legs 18 and 19 cant forwardly and forward legs 21 and 22 cant somewhat rearwardly as shown in FIGS. 2 and 3.

The back frame 12 includes a pair of square tubular slides 30 and 31 reciprocably mounted within chair frame legs 18 and 19 respectively, and fixed together by a cross member 33. Legs 30 and 31 and cross member 33 support a generally U-shaped wooden back cushion frame 36 to which a cushion 37 is attached shown in dotted lines in FIGS. 1 to 3.

The drive assembly 14 includes a frame 39 fixed to lower chair cross frame 26, which carries a vertically oriented drive motor 40 that drives through suitable reduction gearing a generally vertical screw 40 threadedly engaging a drive tube 42 fixed to central portion 43 of chair back cross member 33. A suitable controller 45 is provided for reversing current through motor 40 and reversing rotation of drive screw 41 to raise and lower the back frame 12 as desired.

A pair of short links 50 and 51 are welded to the chair frame slides 30 and 31, to which seat frame member 54 and 55 are pivotally connected at 52 at their rear ends. The seat frame members 54 and 55 are connected by a seat frame forward portion 56. The seat frame side members 54 and 55 carry arm assemblies 57 so that the arm assemblies move as units with the seat frame 16. Similar to the back frame, the seat frame 16 supports a seat cushion 59 shown in dotted lines in the drawings.

A pair of control links 61 control movement of the forward portion of the seat frame 16. Links 61 are pivotally connected at lower end 62 to a forward portion of chair frame cross members 24 and 25 and are pivotally connected at their other ends 64 to the forward extremes of chair side frames 54 and 55.

As seen in FIG. 2, seat frame 16 cants downwardly at approximately 10 degrees from horizontal in the chair down position. In this down position, links 61 have an angle of approximately 45 degrees to horizontal, and note that links 61 have a length somewhat less than one-half the front to back length of the seat frame 16.

Viewing FIGS. 2 and 3, it should be understood that suitable stops are provided for limiting the downward movement of the back frame 12 in the chair frame tubular legs 18 and 19, and that suitable limit switches are provided usually in driver assembly tube 42 to limit upward movement of the back frame 12 in the chair frame 11. As the back frame assembly 12 moves generally vertically and linearly upwardly from its position illustrated in FIG. 2 to its extreme lift position illustrated in FIG. 3, the rear seat pivots 52 move vertically upwardly a distance slightly greater than one-half the front to back length of the seat frame 16. This geometry, together with the position of links 61, dictates the final exit angle of seat frame 16 be approximately 45 degrees forwardly from horizontal and seat cross frame 56 vertical lift be approximately three inches with no substantial rearward movement toward the back frame 12.

We claim:

1. An elevator chair for assisting entry and exit therefrom, comprising: frame means, a back frame slidably mounted on the frame means for generally vertical movement, a seat frame having a rear portion pivotally mounted to the back frame, a generally vertically disposed actuator engageable with the back frame for raising and lowering the back frame and the rear portion of the seat frame, and means movably mounting a forward portion of the seat frame to the frame means constructed so that as the seat moves from a sitting position to a lift position the forward portion of the seat frame moves upwardly to facilitate user entry and exit from the chair.

2. An elevator chair for assisting entry and exit therefrom as defined in claim 1, wherein the means pivotally mounting the forward portion of the seat frame on the frame means includes means for moving the forward portion a greater distance vertically than horizontally as the seat moves from the sitting position to its lift position.

3. An elevator chair for assisting entry and exit therefrom as defined in claim 1, wherein the means pivotally mounting the forward portion of the seat frame on the frame means includes a link pivoted to the forward portion of the seat frame at one end and pivoted to the frame means at a point substantially rearwardly of the point where the link is pivoted to the forward portion.

4. An elevator chair for assisting entry and exit therefrom as defined in claim 1, wherein the back frame has a pair of telescoping members in the frame means and a cross member, said actuator including a threaded shaft and engaging tube assembly connected at one end to the back frame cross member and at the other end to a drive motor, and means for reversely controlling the driver motor.

5. An elevator chair for assisting entry and exit therefrom, comprising: a chair frame, a back frame slidably mounted in the chair frame for vertical movement, a generally vertically disposed actuator at the rear of the chair frame engageable with the back frame to raise and lower the back frame, a seat frame having a rear portion pivotally mounted to the back frame movable with the back frame from a sitting position to an exit position, and link means pivotally connected to a forward portion of the seat frame and pivotally connected to the chair frame at a point that causes the forward portion of the seat frame to move upwardly as the back frame and seat frame move from the sitting position to the exit position.

6. An elevator chair for assisting in entry and exit therefrom as defined in claim 5, wherein the back frame has a pair of telescoping members in the frame means and a cross member, said actuator including a threaded shaft and engaging tube assembly connected at one end to the back frame cross member and at the other end to a driver motor, and means for reversely controlling the driver motor.

7. An elevator chair for assisting entry and exit therefrom, comprising: a chair frame, a back frame slidably mounted in the chair frame for vertical movement, a generally vertically disposed actuator at the rear of the chair frame engageable with the back frame to raise and lower the back frame, a seat frame having a rear portion pivotally mounted to the back frame movable with the back frame from a sitting position to an exit position, link means pivotally connected to a forward portion of the seat frame and pivotally connected to the chair frame at a point that causes the forward portion of the seat frame to move upwardly as the back frame and seat frame move from the sitting position to the exit position, wherein the back frame has a pair of telescoping members in the frame means and a cross member, said actuator including a threaded shaft and engaging tube assembly connected at one end to the back frame cross member and at the other end to a driver motor, and means for reversely controlling the driver motor, said actuator motor including a motor mounted for rotation about one axis parallel to the axis of the threaded shaft and tube assembly.

* * * * *